US010794063B1

(12) United States Patent
Martin

(10) Patent No.: US 10,794,063 B1
(45) Date of Patent: Oct. 6, 2020

(54) TENSION ROD ANCHORS AND RAILINGS

(71) Applicant: Clearview Handrails, Inc., Gainesville, GA (US)

(72) Inventor: Stephen R Martin, Gainesville, GA (US)

(73) Assignee: Clearview Handrails Inc., Gainesville, GA (US)

( * ) Notice: Subject to any disclaimer, the term of this patent is extended or adjusted under 35 U.S.C. 154(b) by 0 days.

(21) Appl. No.: 16/855,977

(22) Filed: Apr. 22, 2020

(51) Int. Cl.
*E04F 11/18* (2006.01)

(52) U.S. Cl.
CPC ..... *E04F 11/1834* (2013.01); *E04F 11/1859* (2013.01); *E04F 2011/1819* (2013.01)

(58) Field of Classification Search
CPC ..... E04F 11/1802; E04F 11/1804; E04F 11/1812; E04F 11/1817; E04F 11/1834; E04F 2011/1819
See application file for complete search history.

(56) References Cited

U.S. PATENT DOCUMENTS

| | | | | | |
|---|---|---|---|---|---|
| 1,663,203 | A * | 3/1928 | Luipersbek | E04F 11/1834 | 403/77 |
| 3,204,898 | A * | 9/1965 | Manning | E04F 11/1812 | 248/516 |
| 7,137,617 | B2 | 11/2006 | Sjostedt | | |
| 7,198,253 | B2 | 4/2007 | Striebel et al. | | |
| 8,205,760 | B2 * | 6/2012 | Chang | A47H 1/102 | 211/105.3 |
| 9,932,754 | B2 * | 4/2018 | Schlatter | E04F 11/1859 | |
| 2015/0204104 | A1 * | 7/2015 | Ostervig | E04F 11/1817 | 256/67 |

FOREIGN PATENT DOCUMENTS

| | | | | |
|---|---|---|---|---|
| AU | 2019219794 A1 | 9/2019 | | |
| CN | 201230646950.3 | 6/2013 | | |
| DE | 94 10 107 | * 11/1994 | E04F 11/18 | |
| DE | 102004020637 B3 | 11/2005 | | |
| JP | 2009-270338 | * 11/2009 | E04F 11/18 | |

OTHER PUBLICATIONS

Atlantis Rail Systems, Raileasy™ Cable Railing Tensioner, Massachusetts, US State, atlantisrail.co m/railing-prodllcVraileasy-cable-rai ling-tensioner, accessed Mar. 20, 2020.
RAM Tail, RAM Tail RT 8017-FM Tension/Fixed End, shelllumber.com/ram-tail-rt-8017-fm-tension/fixed-end.htm, accessed Mar. 20, 2020.

* cited by examiner

*Primary Examiner* — Michael P Ferguson
(74) *Attorney, Agent, or Firm* — Mehrman Law Office; Michael J. Mehrman

(57) ABSTRACT

A tension rod anchor includes a collar that defines a ball race and a ball jack that includes a ball head that forms a swivel joint with the ball race. The ball jack also includes a threaded shaft that engages with a threaded socket of a hosel, which also includes a rod channel that receives a railing rod. A set screw engages with a threaded hole through a side of the hosel into the rod channel. The set screw engages with an anchor hole in the rod, without bearing against the threaded shaft, while the hosel is screwed onto the threaded shaft to tension the rod. Once the desired tension has been obtained, the set screw is screwed down further and tightened to secure the rod with the rod under tension. The swivel joints allow rod railings to be easily installed at angles and inclines.

5 Claims, 7 Drawing Sheets

(top view)

(top view)

(side view)

(side view)

TENSION ROD ANCHORS AND RAILINGS

TECHNICAL FIELD

The present invention is directed to see-through railings and, more particularly, to safe, easy to install, and aesthetically pleasing tension rod anchors and railings for residential and commercial locations.

BACKGROUND

Cable railings that minimize the visual obstruction caused by the railings are popular options for residential and commercial locations. However, some people find the cables unattractive and the relatively thin cables can provide uncomfortable restraints for people and pets running or bumping into the cables. The cable anchor tensioning systems can also be difficult to install and require occasional adjustment to maintain the cables under proper tension. Some designs present the added difficulty of requiring angled and inclined holes to be drilled through the support posts for angled and inclined railing sections.

Rod railings overcome some of these shortcomings but the rods are often installed with loose connections that provide inadequate and unsafe restraints. Again, some designs are difficult to install on angles and inclines requiring angled and inclined holes to be drilled through the support posts. Cable and rod railing systems also tend to be expensive options requiring professional installation. An inexpensive, more secure, and easy to install rod railing systems is therefore needed to improve the performance and increase the market for rod railing systems.

SUMMARY

The needs described above are met by tension rod anchors and railings that are safe, easy to install, and aesthetically pleasing options for residential and commercial locations. The tension rod anchor includes a collar having a ball race and fastener holes for securing the collar to a support structure. A ball jack includes a ball head and a threaded shaft extending from the ball head. The ball head is sized to be captured by the ball race and form a swivel joint between the ball jack and the collar. A hosel includes a threaded socket engaged with the threaded shaft of the ball jack, a rod channel shaped to receive an end portion of the rod, and a threaded hole positioned to align with an anchor hole through the end portion of the rod. A set screw is shaped to engage with the threaded hole of the hosel and extend from the threaded hole through the anchor hole of the rod and against the threaded shaft of the ball jack to selectively secure the end portion of the rod between the hosel and the ball jack. The hosel rotates on the threaded shaft to translate along shaft to selectively tension the rod. In addition, the set screw rotates within the threaded hole of the hosel to engage the anchor hole of the rod without bearing against the threaded shaft of the ball jack to selectively tension the rod. Once the desired tension is obtained, the set screw is further rotated to tighten the set screw to secure the rod under tension between the hosel and the ball jack.

To secure a railing rod extending in an axial dimension between a proximal end portion and a distal end portion under tension, a first tension rod anchor is secured to a first support structure. The distal end portion of the rod is secured to the first tension rod anchor and a second tension rod anchor is secured to a second support structure. The proximal end portion of the rod is secured to the second tension rod anchor by screwing the hosel on the threaded shaft of the ball jack in a first direction (e.g., clockwise) to translate the hosel in the proximal direction sufficiently to clear the proximal end portion of the rod past a distal end of the hosel. The proximal end portion of the rod is then aligned with the rod channel of the hosel, which is screwed on the threaded shaft of the ball jack in a second direction (e.g., counterclockwise) to translate the hosel in the distal direction sufficiently to align the threaded hole of the hosel with the anchor hole of the rod. A set screw is then screwed into the threaded hole of the hosel until it engages the anchor hole of the rod without bearing against the threaded shaft of the ball jack. The hosel is then screwed on the threaded shaft again in the first direction (e.g., clockwise) to translate the hosel in the proximal direction to tension the rod. Once the desired tension is obtained, the set screw is screwed further into the threaded hole of the hosel until the set screw tightens against the threaded shaft of the ball jack to secure the proximal end of the rod between the hosel and the threaded shaft of the ball jack with the rod under tension. A pliers may be applied to a pinch profile of the ball jack to prevent the ball jack from rotating while tensioning the rod, while a wrench is applied to a wrench profile of the hosel to rotate the hosel while tensioning the rod. The swivel joints allow rod railings to be easily installed at angles and inclines.

It will be understood that specific embodiments may include a variety of features in different combinations, as desired by different users. The specific techniques and systems for implementing particular embodiments of the invention and accomplishing the associated advantages will become apparent from the following detailed description of the embodiments and the appended drawings and claims.

BRIEF DESCRIPTION OF THE FIGURES

The numerous advantages of the embodiments of the invention may be better understood with reference to the accompanying figures.

DETAILED DESCRIPTION

Embodiments of the invention may be embodied in tension rod anchors and railings that are safe, easy to install, and aesthetically pleasing options for residential and commercial locations. Generally described, the tension rod anchor includes a collar that defines a ball race. A ball jack includes a ball head that forms a swivel joint with the ball race of the collar. The ball jack also includes a threaded shaft that engages with a threaded socket of a hosel, which also includes a rod channel that receives a railing rod. A set screw engages with a threaded hole through a side of the hosel into the rod channel. The set screw engages with an anchor hole in the rod, without bearing against the threaded shaft of the ball jack, while the hosel is screwed onto the threaded shaft of the ball jack to tension the rod. Once the desired tension has been obtained, the set screw is screwed down further and tightened against the threaded shaft of the ball jack to secure the rod between the hosel and the threaded shaft with the rod under tension. The swivel joints allow rod railings to be easily installed at angles and inclines.

Figure 1:
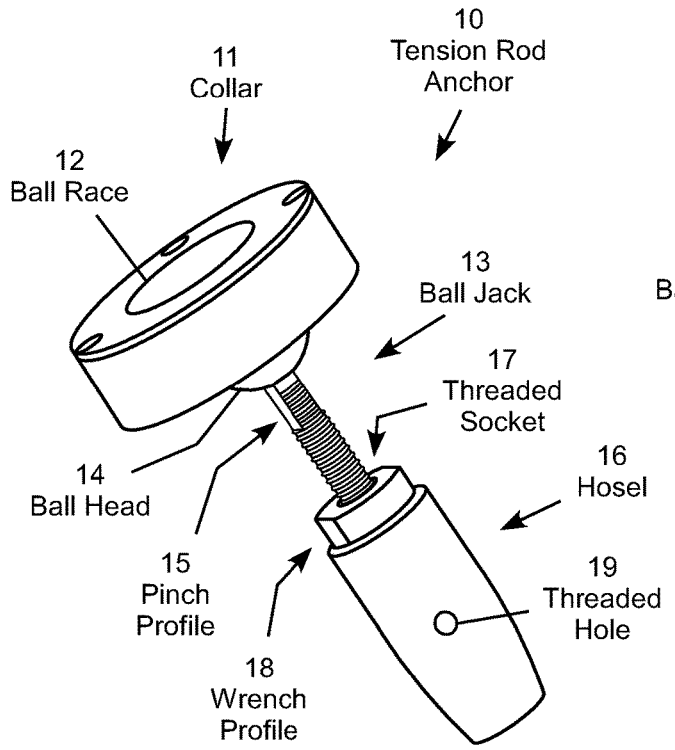
FIG. 1 is a perspective view of a tension rod anchor embodiment of the present invention.
Figure 2:
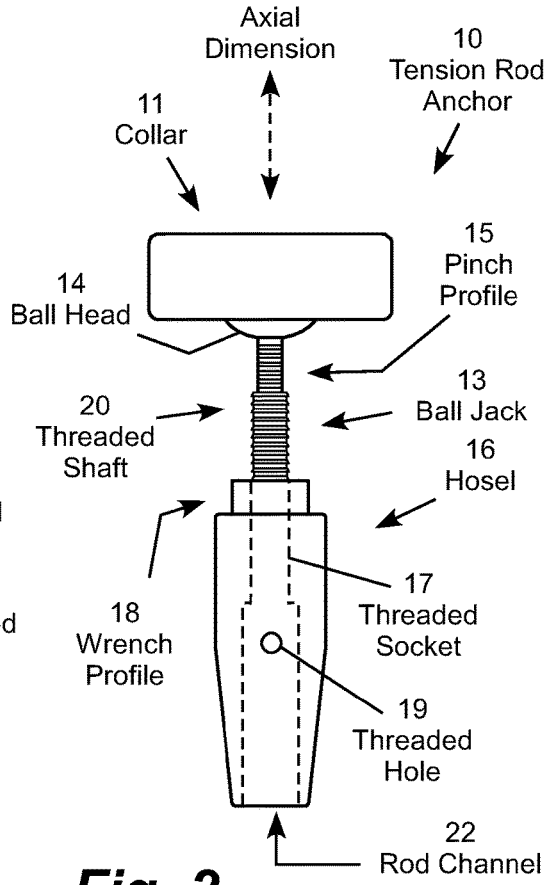
FIG. 2 is a side view of the tension rod anchor.
Figure 3:
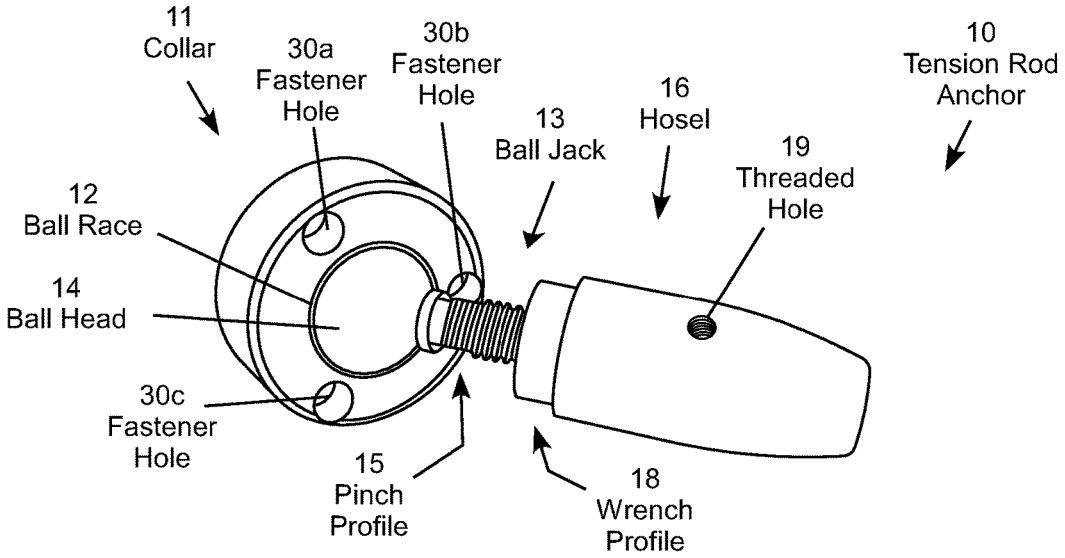
FIG. 3 is another perspective view of the tension rod anchor.
Figure 4:
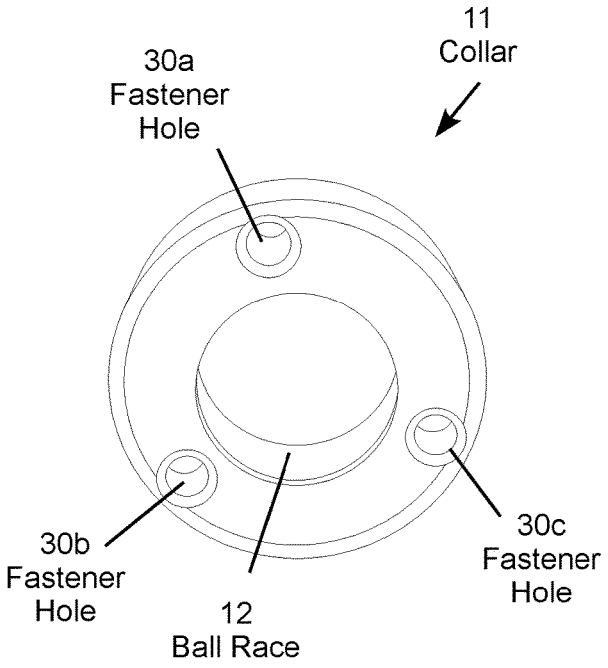
FIG. 4 is perspective view a collar of the tension rod anchor.
Figure 5:
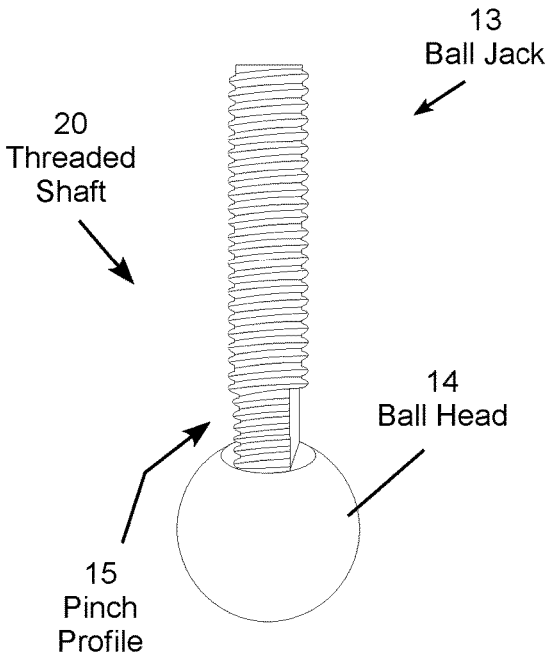
FIG. 5 is perspective view a ball jack of the tension rod anchor.
Figure 6:
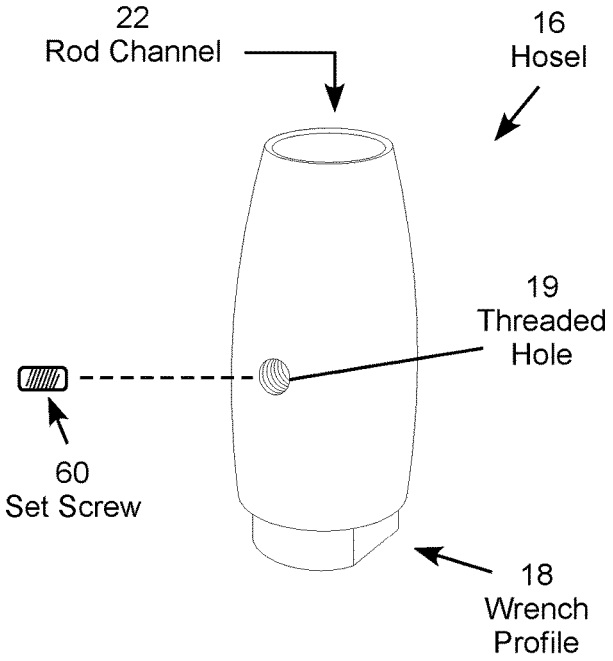
FIG. 6 is perspective view a hosel of the tension rod anchor.

FIG. 1 is a perspective view, FIG. 2 is a side view, and FIG. 3 is another perspective view of a representative embodiment of the tension rod anchor 10 used to secure a rod railing to a support structure, such as a post, wall, frame or other suitable support structure. The tension rod anchor 10 includes a collar 11, a ball jack 13 elongated in an axial dimension, and a hosel 16 that is also elongated in the axial dimension. FIGS. 4, 5 and 6 are perspective views of the collar 11, ball jack 13, and hosel 16, respectively. In this example, the collar 11 includes fastener holes 30*a-c* used to attach the collar to a post to secure the collar at an end of a rod railing. The collar 11 includes a ball race 12 that captures a ball head 14 of the ball jack 13 while allowing the ball head to articulate within the ball race to create a swivel joint between the ball jack and the collar. The ball jack 13 includes a threaded shaft 20 extending from the ball head 14 that engages with a threaded socket 17 of the hosel 16. Rotating the hosel 16 about the axial dimension with respect to the ball jack 13 causes to the hosel 16 to translate axially along the threaded shaft 20. The hosel 16 includes a rod channel 22 for receiving an end portion of the railing rod. The hosel 16 also includes a threaded hole 19 for receiving a set screw 60 that is used to secure the rod between the hosel and the threaded shaft 20 of the ball jack 13. In this embodiment, the ball jack 13 includes a pinch profile 15 that can be grasped with pliers, while the hosel 16 includes a wrench profile 18 that can be grasped with a wrench, to facilitate rotating the hosel 16 with respect to the ball jack 13 to tension the rod. When the other end of the rod is held in place, tension on the rod can therefore be increased or decreased by rotating the hosel 16 with respect to the ball jack 13 to translate the hosel axially along the threaded shaft 20 of the ball jack. For example, rotating the hosel clockwise typically increases the tension, while rotating the hosel counter-clockwise typically decreases the tension.

Figure 7:
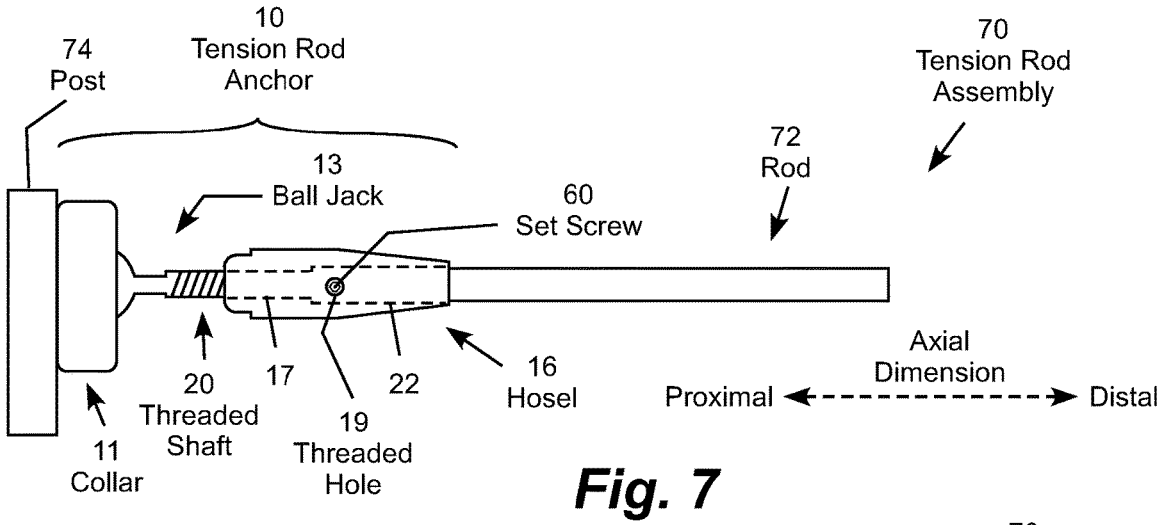
FIG. 7 is a side view of a tension rod assembly.
Figure 8:
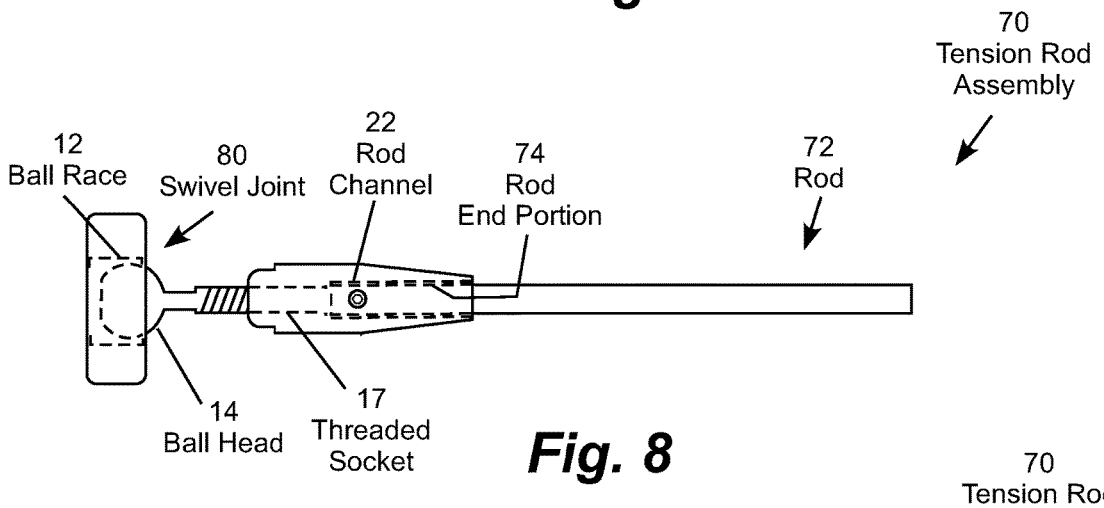
FIG. 8 is another side view of the tension rod assembly showing certain internal features.
Figure 9:
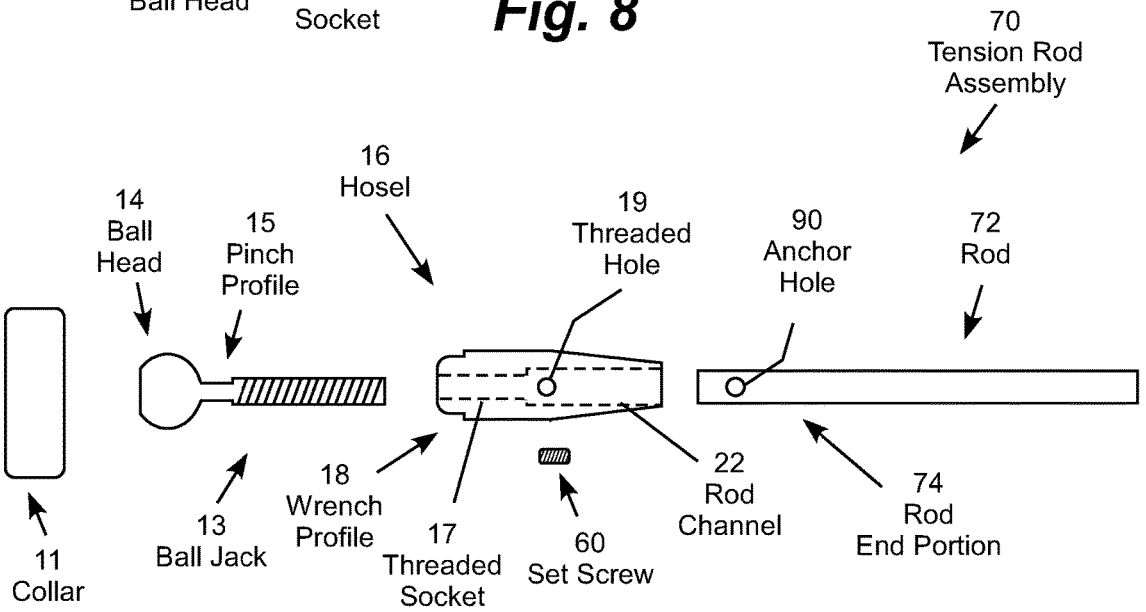
FIG. 9 is a side assembly view of the tension rod assembly.

FIG. 7 and FIG. 8 are side views and FIG. 9 is a side assembly view of a tension rod assembly 70, which includes the tension rod anchor 10 described above and a railing rod 72. FIG. 7 illustrates the axial dimension along with the proximal and distal directions to facilitate the description of the rod tensioning procedure. The collar 11 at the proximal end of the tension rod anchor 10 is secured to a support structure 74, such as a post, wall, frame or other suitable support structure. The end portion 74 of the rod 72 is secured within the rod channel 22, which has an opening at the distal end of the hosel 16. The ball head 14 of the ball jack 13 captured within the ball race 12 of the collar 11 forms a swivel joint 80. The end portion 74 of the rod 72 includes an anchor hole 90 that receives the set screw 60 extending through the threaded hole 19 of the hosel 16 into the rod channel 22 to secure the rod between the hosel and the threaded shaft 20 of the ball jack 13.

With the opposing end of the rod 72 held in place (typically by an opposing tension rod anchor) and the ball jack 13 prevented from rotating within the collar 11, the hosel 16 is rotated in an initial direction (e.g., clockwise) with respect the ball jack 13 to translate the hosel in the proximal direction on the ball jack a sufficient distance to allow the proximal end of the rod 72 to clear the distal end of the hosel. The end portion 74 of the rod 72 is then aligned with the rod channel 22 of the hosel 16, and the hosel is rotated in an opposing direction (e.g., counter-clockwise) to translate the hosel in the distal direction a sufficient distance to draw the rod channel over the end portion of the rod until the threaded hole 19 of the hosel is aligned with the anchor hole 90 of the rod 72. The set screw 60 is then screwed into the threaded hole 19 until the set screw engages with the anchor hole 90 but does not bear against the threaded shaft 20 of the ball jack 13. At this point, the hosel is rotated again in the initial direction (e.g., clockwise) to translate the hosel in the proximal direction a sufficient distance to tension the rod 72. Once the rod 72 has been tensioned the desired amount, the set screw 60 is screwed further into the threaded hole 19 until the set screw bears tightly against the threaded shaft 20 of the ball jack 13, which tightens the rod in place under the desired amount of tension. A pliers applied to the pinch profile 15 of the ball jack 13 may be used to keep the ball jack from rotating, and a wrench may be applied to the wrench profile 18 to rotate hosel 16, while tensioning the rod 72.

Figure 10:
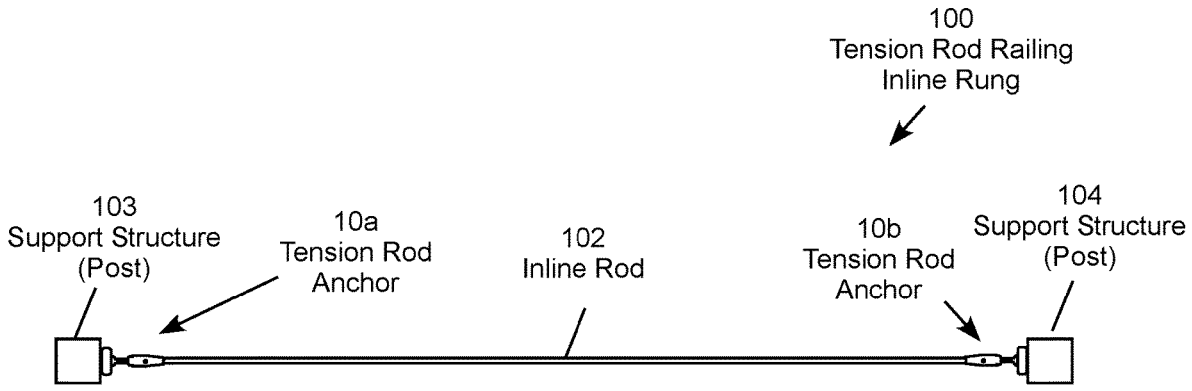
FIG. 10 is a top view of a tension rod railing inline rung.
Figure 11:
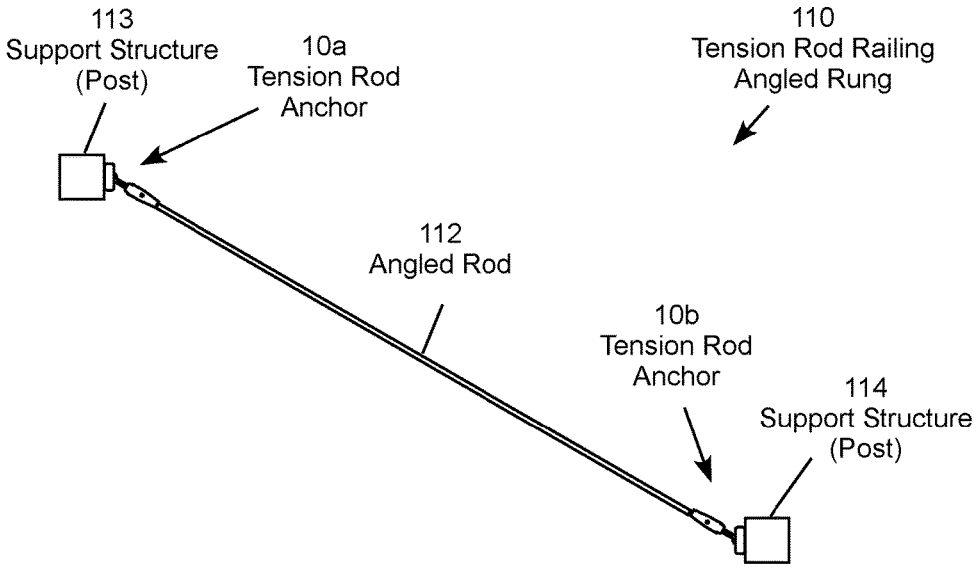
FIG. 11 is a top view of a tension rod railing angled rung.
Figure 12:
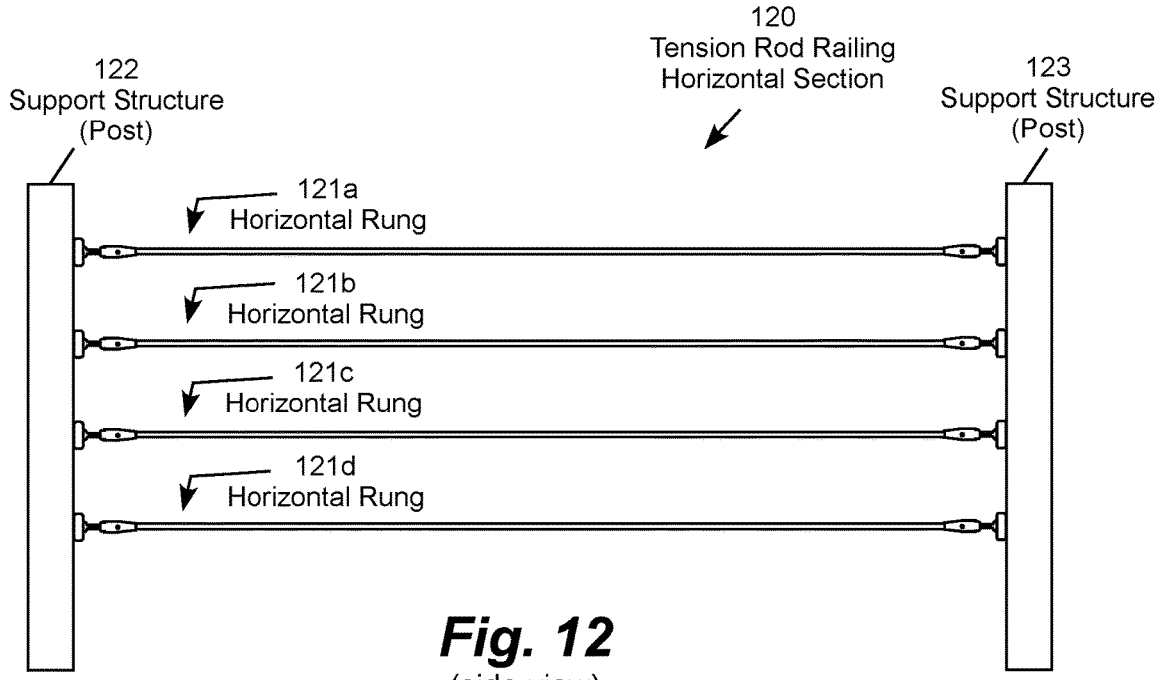
FIG. 12 is a side view of a tension rod railing horizontal section.
Figure 13:
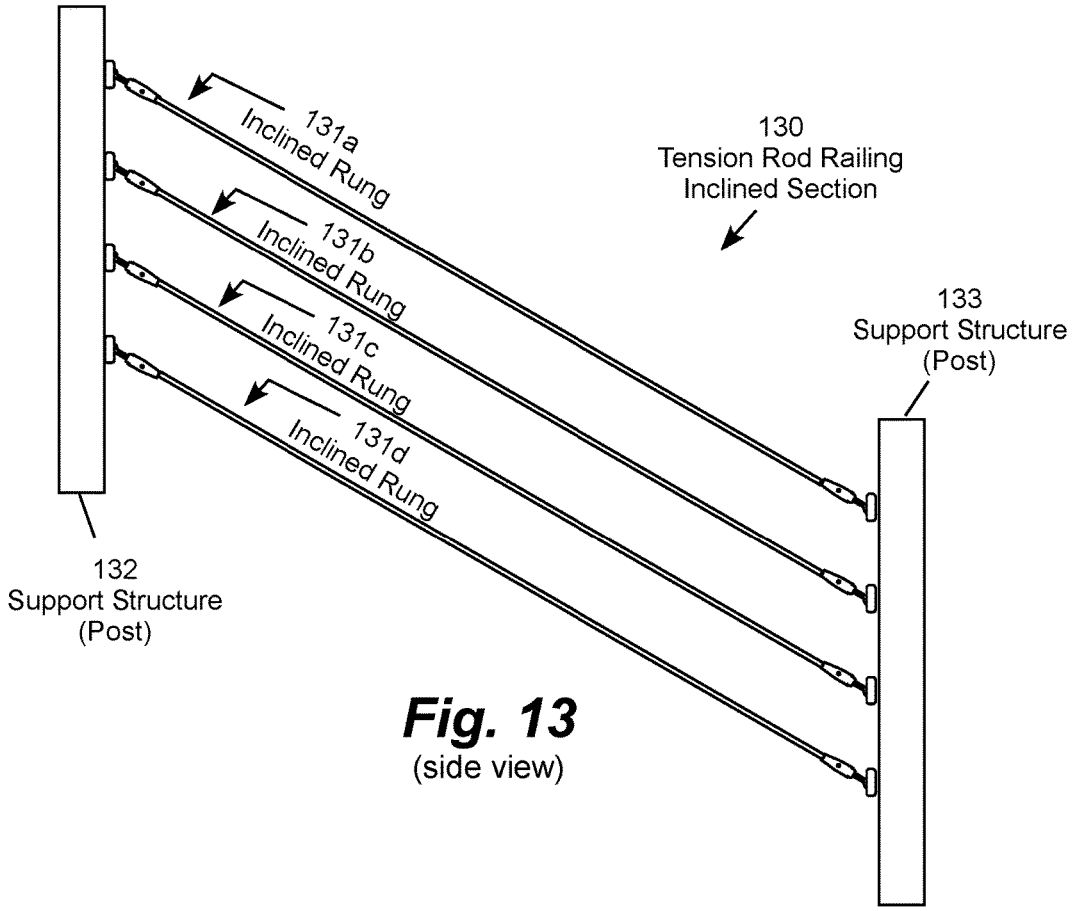
FIG. 13 is a side view of a tension rod railing inclined section.

The FIG. 10 is a top view of a tension rod railing inline rung 100, which can be installed and tensioned using the procedure described above. The inline rung 100 includes a rod 102 supported inline between tension rod anchors 10*a* and 10*b* connected to support structures 103 and 104, respectively. The swivel joints of the tension rod anchors 10*a* and 10*b* allow a rod railing to be easily installed on a desired angle. For example, FIG. 11 is a top view of a tension rod railing angled rung 110 that includes a rod 112 supported on an angle between tension rod anchors 10*a* and 10*b* connected to support structures 113 and 114, respectively. As another example, FIG. 12 is a side view of a tension rod railing horizontal section 120, which includes four horizontal rungs 121*a*-121*d* connected between support structures 122 and 123. The swivel joints of the tension rod anchors allow the rungs to be easily installed on an incline. For example, FIG. 13 a side view of a tension rod railing inclined section 130 suitable for use on stairs, which includes four inclined rungs 131*a*-131*d* connected between support structures 132 and 133.

Figure 14:
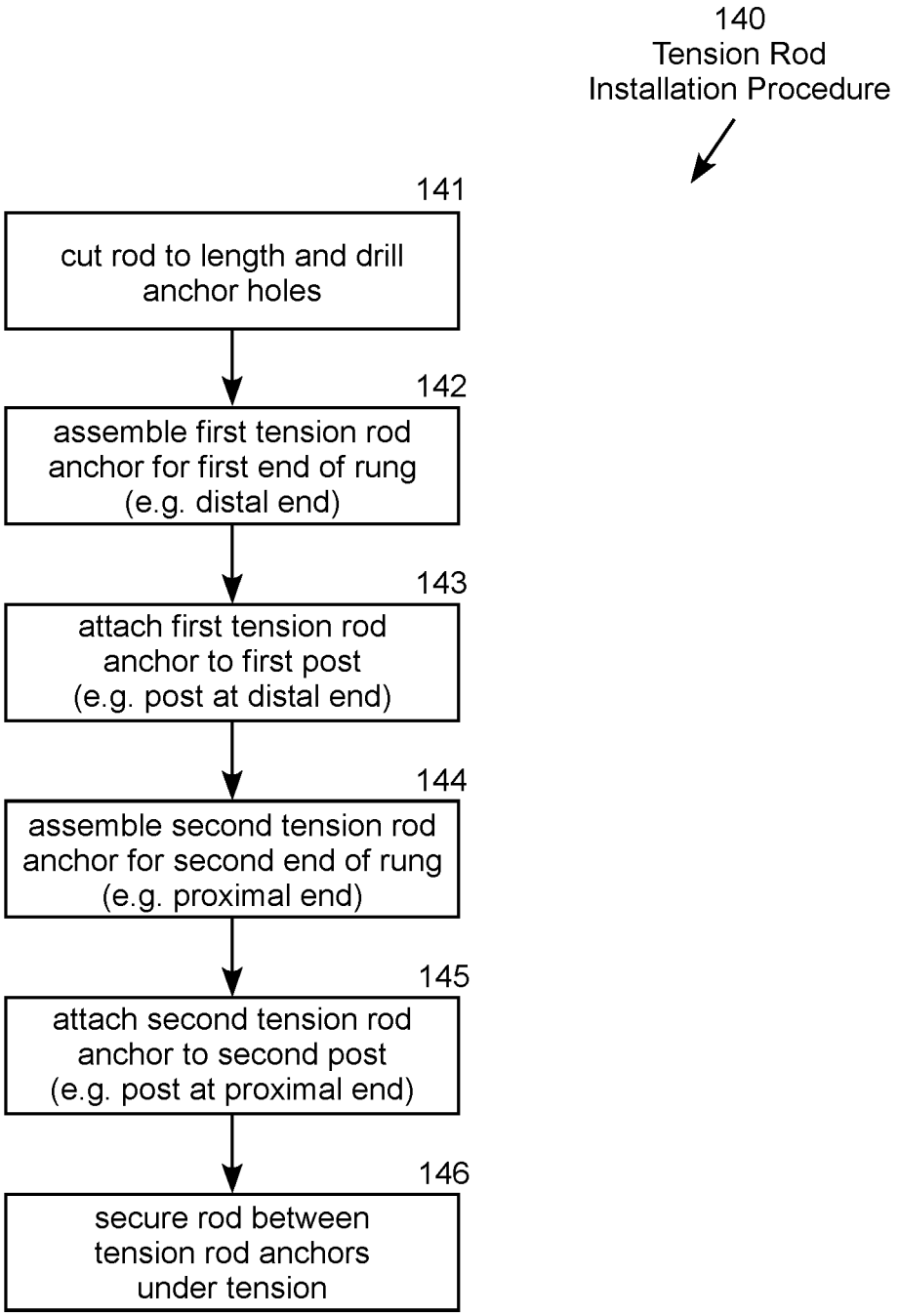
FIG. 14 is a logic flow diagram for a tension rod installation procedure.

FIG. 14 is a logic flow diagram for a tension rod installation procedure 140 performed by an installer to connect a rod railing rung. In step 141, the installer cuts a rod for a railing rung to the desired length and drills anchor holes through the end portions of the rod suitable for engaging the rod with the tension rod anchors. Step 141 is followed by step 142, in which the installer assembles a first tension rod anchor for a first end of the rung, for example at the distal end of the rung. Step 142 is followed by step 143, in which the installer attaches the first tension rod anchor to a first support structure, in this example a post at the distal end of the rung. The collar of the tension rod anchor is attached to the post using screws, bolts or other suitable fasteners with the ball head of the ball jack captured in the ball race of the collar. Step 143 is followed by step 144, in which the installer assembles a second tension rod anchor for the second opposing end of the rung, in this example at the proximal end of the rung. Step 144 is followed by step 145, in which the installer attaches the second tension rod anchor to a second support structure, in this example a post at the proximal end of the rung. Step 145 is followed by step 146, in which the installer secures the rod under tension between the tension rod anchors, as described in greater detail below with reference to FIG. 15.

Figure 15:
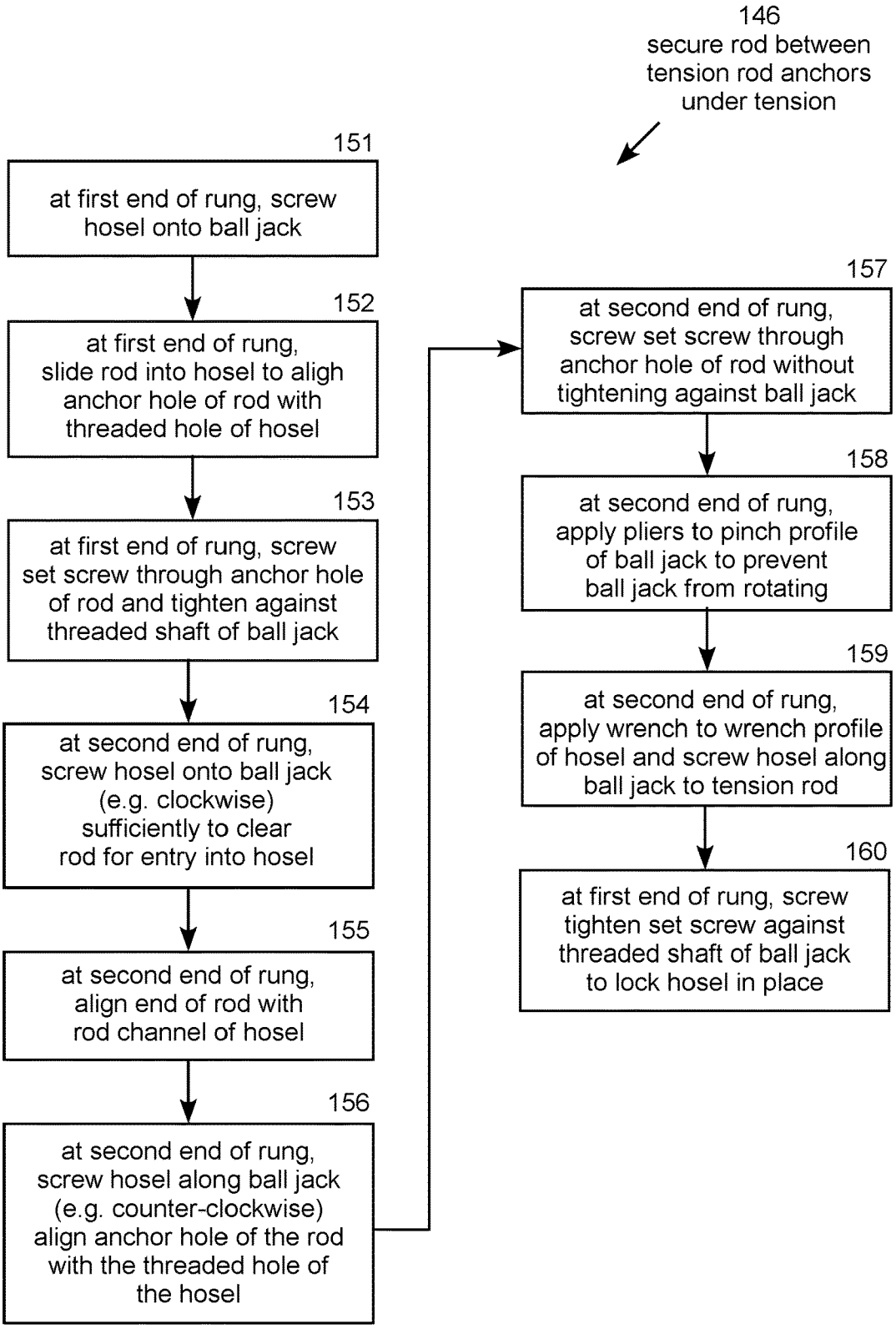
FIG. 15 is a logic flow diagram for securing a rod under tension between tension rod anchors.

FIG. 15 is an expanded logic flow diagram for step 146, which is procedure 150, in which the technician secures the rod under tension between the tension rod anchors. In step 151, the installer screws the hosel onto the threaded shaft of the ball jack at the first end of the rung, in this example the distal end of the rung. The installer typically screws the first anchor onto the ball jack with a portion of the threaded shaft remaining exposed to allow for subsequent tensioning of the rod at the distal end. Step 151 is followed by step 152, in which the installer slides the distal end portion of the rod into the rod channel of the hosel until the anchor hole of the rod is aligned with the threaded hole of hosel. To facilitate the installation, this alignment typically occurs when the rod is fully inserted to the bottom of the rod channel of the hosel. Step 152 is followed by step 153, in which the installer screws a set screw into the threaded hole of hosel, through the anchor hole of the rod, and tightens the set screw against the threaded shaft of the ball jack. This locks the rod in place at the distal end of the rung. The first end of the rung usually can be installed by hand, without a pliers and wrench, because the rod is not under tension at this point.

At this point, the first (distal) end of the rod is secured to the first tension rod anchor attached to the first support structure, and the following steps describe how the second (proximal) end of the rod is secured to the second tension rod anchor attached to the second support structure. Step 153 is followed by step 154, in which the installer screws the hosel in an initial direction (e.g., clockwise) onto the threaded shaft of the ball jack a sufficient distance in the proximal direction to allow the end of the rod to clear the hosel. The length of the rod is typically cut so that this clearance occurs when the hosel has been screwed nearly fully onto the threaded shaft of the ball jack. Step 154 is followed by step 155, in which the installer aligns the end of the rod with the rod channel of the hosel. Step 155 is followed by step 156, in which the installer screws the hozel in the opposite direction (e.g., counter-clockwise) to translate the hosel along the threaded shaft in the distal direction a sufficient distance to align the anchor hole of the rod with the threaded hole of hosel. Again, this alignment typically occurs when the rod is fully inserted to the bottom of the rod channel of the hosel. Step 156 is followed by step 157, in which the installer screws a set screw into the threaded hole of hosel and through the anchor hole of the rod, but does not tighten the set screw against the threaded shaft of the ball jack. Step 157 is followed by step 158, in which the installer pinches the ball jack to prevent it from rotating, typically by applying a pliers to the pinch profile of the ball jack. Step 158 is followed by step 159, in which the installer uses a wrench to screw the hosel in the initial direction (e.g., clockwise), which in this example translates the hosel in the proximal direction to tension the rod between the tension rod anchors. Once the desired tension has been obtained, step 159 is followed by step 160, in which the installer tightens the set screw against the threaded shaft of the ball jack to lock the rod in place with the rod under the desired amount of tension.

The tension rod anchors and rods are preferably fabricated from stainless steel, electro plated brass, high-durability polymeric materials (e.g., ABS, polycarbonates, fluoropolymers), or another material suitable for long term durability in outdoor settings. The tension rod anchors are typically attached to wooden posts or metal posts with pre-drilled threaded holes positioned to align with the fastener holes in the collars of the anchors. Other types of fasteners may be used as a matter of design choice, such as a collar that slides into a flange anchor attached to the support surface, a collar that screws into an anchor attached to the support surface, a collar that bears against an opposing side of the support structure, and so forth.

The tension rod anchors and component parts may be sold separately or as custom designed kits with rods for specific rod railing systems. Additional parts, such as top rails and posts, may be also be sold separately or included as part of custom designed kits. The round cross-sectional shape of the collar and hosel shown in the figures is merely illustrative. The collar and/or hosel may have other cross-sectional shapes, such as oval, square, rectangular, hexagonal, and so forth. In addition, while the smooth tapered shape of the hosel in the axial dimension is considered appealing, this is feature is merely illustrative and other shapes, such as those with a flare, twist or surface ornamentation may be employed as a matter of design choice.

While particular aspects of the present subject matter have been shown and described in detail, it will be apparent to those skilled in the art that, based upon the teachings of this disclosure, changes and modifications may be made without departing from the subject matter described in this disclosure and its broader aspects and, therefore, the appended claims are to encompass within their scope all such changes and modifications as are within the true spirit and scope of the subject matter described in this disclosure. Although particular embodiments of this disclosure have been illustrated, it is apparent that various modifications and embodiments of the disclosure may be made by those skilled in the art without departing from the scope and spirit of the disclosure.

It is believed that the present disclosure and many of its attendant advantages will be understood by the foregoing description, and it will be apparent that various changes may be made in the form, construction and arrangement of the components without departing from the disclosed subject matter or without sacrificing all of its material advantages. The form described is merely explanatory, and it is the intention of the following claims to encompass and include such changes. The disclosure is defined by the following claims, which should be construed to encompass one or more structures or function of one or more of the illustrative embodiments described above, equivalents and obvious variations. It will therefore be appreciated that the present invention provides significant improvements. The foregoing relates only to the exemplary embodiments of the present invention, and that numerous changes may be made therein without departing from the spirit and scope of the invention as defined by the following claims.

The invention claimed is:

1. A method for securing a railing rod extending in an axial dimension between a hollow proximal end portion and a distal end portion under tension, comprising:

securing a first tension rod anchor to a first support structure;

securing the distal end portion of the railing rod to the first tension rod anchor;

securing a second tension rod anchor to a second support structure, the second tension rod anchor comprising:

a collar connected to the second support structure comprising a ball race, a ball jack comprising a ball head forming a swivel joint with the ball race of the collar and a threaded shaft extending in the axial dimension from the ball head, and a hosel extending in the axial dimension comprising a threaded socket engaged with the threaded shaft of the ball jack, a rod channel sized to receive the proximal end portion of the railing rod, and a threaded hole extending in a transverse dimension transverse to the axial dimension through a side of the hosel into the rod channel;

securing the proximal end portion of the railing rod to the second tension rod anchor by:

screwing the hosel on the threaded shaft of the ball jack in a first direction around the axial dimension to translate the hosel in the proximal direction sufficiently to clear the proximal end portion of the railing rod past a distal end of the hosel, aligning the proximal end portion of the railing rod with the rod channel of the hosel, screwing the hosel on the threaded shaft of the ball jack in a second direction around the axial dimension to translate the hosel in the distal direction sufficiently to align the threaded hole of the hosel with an anchor hole of the railing rod, screwing a set screw into the threaded hole of the hosel until it engages the anchor hole of the railing rod without bearing against the threaded shaft of the ball jack, screwing the hosel on the threaded shaft again in the first direction around the axial dimension to translate the hosel in the proximal direction to draw a portion of the threaded shaft of the ball jack into the hollow proximal end portion of the railing rod until the anchor hole of the railing rod is positioned in the transverse dimension between the threaded hole of the hosel and the portion of the threaded shaft of the ball jack, and to tension the railing rod, and screwing the set screw further into the threaded hole of the hosel until the set screw tightens against the portion of the threaded shaft of the ball jack to secure the proximal end of the railing rod between the hosel and the portion of the threaded shaft of the ball jack with the railing rod under tension.

2. The method of claim 1, further comprising applying a pliers to a pinch profile of the ball jack to prevent the ball jack from rotating while tensioning the railing rod.

3. The method of claim 1, further comprising applying a wrench to a wrench profile of the hosel to rotate the hosel while tensioning the railing rod.

4. The method of claim 1, further comprising articulating the ball jack with respect to the collar to secure the railing rod at an angle with respect to the second support structure.

5. The method of claim 1, further comprising articulating the ball jack with respect to the collar to secure the railing rod at an incline with respect to the second support structure.

* * * * *